US007523711B2

(12) United States Patent
Takahashi et al.

(10) Patent No.: US 7,523,711 B2
(45) Date of Patent: Apr. 28, 2009

(54) HORIZONTAL ROTARY HOOK FOR SEWING MACHINE

(75) Inventors: Masakazu Takahashi, Tochigi (JP); Shin Ota, Aichi (JP); Katsuhiro Kitajima, Gifu (JP); Toshio Abe, Aichi (JP)

(73) Assignees: E. I. du Pont de Nemours and Company, Wilmington, DE (US); Brother Kogyo Kabushiki Kaisha, Aichi-Ken (JP)

( * ) Notice: Subject to any disclaimer, the term of this patent is extended or adjusted under 35 U.S.C. 154(b) by 144 days.

(21) Appl. No.: 11/284,164

(22) Filed: Nov. 21, 2005

(65) Prior Publication Data

US 2006/0150877 A1 Jul. 13, 2006

(30) Foreign Application Priority Data

Nov. 24, 2004 (JP) ..... 2004-338541

(51) Int. Cl.
*D05B 57/14* (2006.01)
*D05B 57/16* (2006.01)

(52) U.S. Cl. ..... 112/230

(58) Field of Classification Search ..... 112/185, 112/181, 187, 189, 196, 228, 230, 231
See application file for complete search history.

(56) References Cited

U.S. PATENT DOCUMENTS 1,431,380 A * 10/1922 Dickson ..... 112/228
3,139,050 A * 6/1964 Grabowski ..... 112/38
3,140,681 A * 7/1964 Corey ..... 112/228
3,465,700 A * 9/1969 Kuhar ..... 112/228
4,278,038 A 7/1981 Johnson
4,660,487 A * 4/1987 Mikuni ..... 112/230
5,158,029 A * 10/1992 Hirose ..... 112/230
5,427,042 A * 6/1995 Yamasaki ..... 112/230
5,617,803 A * 4/1997 Badillo ..... 112/230
6,807,918 B2 * 10/2004 Chang ..... 112/230
7,197,994 B2 * 4/2007 Takahashi et al. ..... 112/185
2003/0172859 A1 9/2003 Chang

FOREIGN PATENT DOCUMENTS

JP U-S60-149388 10/1985

OTHER PUBLICATIONS

PCT International Search Report and Written Opinion for International Application No. PCT/US2005/042770 dated Apr. 12, 2006.

* cited by examiner

*Primary Examiner*—Ismael Izaguirre

(57) ABSTRACT

The present invention is a horizontal rotary hook for a sewing machine includes an inner bobbin case holder, an outer rotating hook made of a synthetic resin, a sliding surface formed on the rotating hook so as to be slid relative to the bobbin case holder with rotation of the rotating hook while an outer periphery of the bobbin case holder is placed on the rotating hook, an opening defined in an outer peripheral wall of the rotating hook so that a needle thread passes through the opening, and a beak mounted on an outer peripheral wall of the rotating hook for seizing a loop of the needle thread.

7 Claims, 8 Drawing Sheets

HORIZONTAL ROTARY HOOK FOR SEWING MACHINE

CROSS-REFERENCE TO RELATED APPLICATIONS

This application is based upon and claims the benefit of priority from the prior Japanese Patent Application No. 2004-338541, filed on Nov. 24, 2004, the entire contents of which are incorporated herein by reference.

TECHNICAL FIELD

The disclosure relates to a horizontal rotary hook for a sewing machine which includes an inner bobbin-case holder for accommodating a bobbin and an outer rotating hook which has a beak and accommodates the bobbin case holder, and more particularly to such a horizontal rotary hook for a sewing machine in which the beak is a component separated from the rotating hook.

BACKGROUND

A horizontal rotary hook providing an easy replacement of a bobbin has conventionally been used in sewing machines. The horizontal rotary hook comprises an outer rotating hook formed with a lace and an inner bobbin case holder which accommodates a bobbin and is held so as to be rotatable relative to the lace face. The rotating hook is adapted to be rotated in a predetermined direction by a sewing machine motor or the like.

The bobbin case holder is made of a synthetic resin so that a reduction is achieved in the weight and production cost thereof. Furthermore, the rotating hook has also been made of a synthetic resin recently. In this case, a beak is provided on an outer peripheral wall of the rotating hook for seizing a loop of bobbin thread. However, when the beak is formed integrally on the rotating hook, the structure of a forming die used for forming the rotating hook is complicated. Furthermore, the beak necessitates a higher strength than the other part of the rotating hook. In view of these problems, a beak member provided with a beak has been proposed to be formed separately from the rotating hook and mounted on the rotating hook. For example, JP-U-S60-149388 discloses a horizontal rotary hook in which a beak is made of a metal and mounted on an inner peripheral surface of an outer peripheral wall of the hook so as to be laid on the inner peripheral surface.

However, a thickness of a part of the rotating hook on which the beak member is laid is increased when the beak member is mounted inside the outer peripheral wall of the rotating hook. Consequently, the size of the horizontal rotary hook is increased.

In order that the increase in the size of the overall horizontal rotary hook may be limited, the beak member is suggested to be disposed in an opening formed by cutting out the outer peripheral wall of the horizontal rotary hook and mounted to the bottom of the rotating hook by screws so as to joined to the rotating hook. However, when the beak member is simply mounted to the bottom of the rotating hook made of the synthetic resin, a sewing thread is entangled in a space defined between the inner rotating hook and the beak member. Upon occurrence of such thread entanglement, the beak member is instantaneously subjected to a large external stress traveling outward. As a result, the beak member is deformed or a part of the beak member mounted to the outer rotating hook is damaged.

SUMMARY

Therefore, an object of the disclosure is to provide a horizontal rotary hook for a sewing machine, in which a beak member separate from the outer rotating hook can be mounted on the rotating hook reliably and rigidly while the thickness of the outer peripheral wall of the rotating hook is prevented from being increased.

In one aspect, the disclosure provides a horizontal rotary hook for a sewing machine, which includes an inner bobbin case holder accommodating a bobbin therein and an outer rotating hook accommodating the bobbin case holder and rotated in a predetermined direction with the bobbin case holder being accommodated in the rotating hook, the rotating hook having an outer peripheral wall formed with a bobbin-thread passing opening through which the bobbin thread passes, the horizontal rotary hook comprising an enlarged opening defined in the outer peripheral wall of the rotating hook so as to be continuous to the bobbin-thread passing opening, a beak member separate from the rotating hook and mounted on the rotating hook so as to close the enlarged opening, and a fitting holder provided on the rotating hook so that a lower part of the beak member is fitted thereinto, thereby holding the beak member.

According to the above-described aspect of the disclosure, the beak member is mounted on the rotating hook so as to close the enlarged opening. Accordingly, since the beak member is prevented from being laid on the outer peripheral wall of the rotating hook, the thickness of the outer peripheral wall of the rotating hook and accordingly, the entire size of the horizontal rotary hook can be prevented from being increased. Further, since the beak member is held by the holder while being fitted therein, the beak member can be mounted on the rotating hook reliably and firmly. Additionally, only the beak member needs to be replaced even when the loop seizing beak has broken. Consequently, the replacement of the beak member can render the repair cost lower than the replacement of the entire rotating hook.

In one embodiment of the disclosure, the beak member has an outer surface, the rotating hook has a bottom, and the fitting holder is formed so as to protrude outward from the outer peripheral wall of the rotating hook and has a reinforcing peripheral wall continuous to the outer peripheral wall of the rotating hook and supporting the outer surface of the beak member and a reinforcing bottom continuous to the bottom of the rotating hook. Consequently, even if thread entanglement causes the beak member to be subjected to an outgoing force, the outer surface side of the beak member can be received and supported by the reinforcing peripheral wall, whereupon the mounting strength of the beak member against an outward stress can be improved.

In another embodiment of the disclosure, the beak member is made of a synthetic resin and as a result, the production cost can be reduced. When both beak member and outer rotating hook are made of a synthetic resin, different materials can be used so that the material for the beak member has a higher hardness. Consequently, the strength of the beak member can be improved.

BRIEF DESCRIPTION OF THE DRAWINGS

Other objects, features and advantages of the disclosure will become clear upon reviewing the following description of the illustrative aspects with reference to the accompanying drawings, in which.

DETAILED DESCRIPTION OF THE INVENTION

Figure 1A:
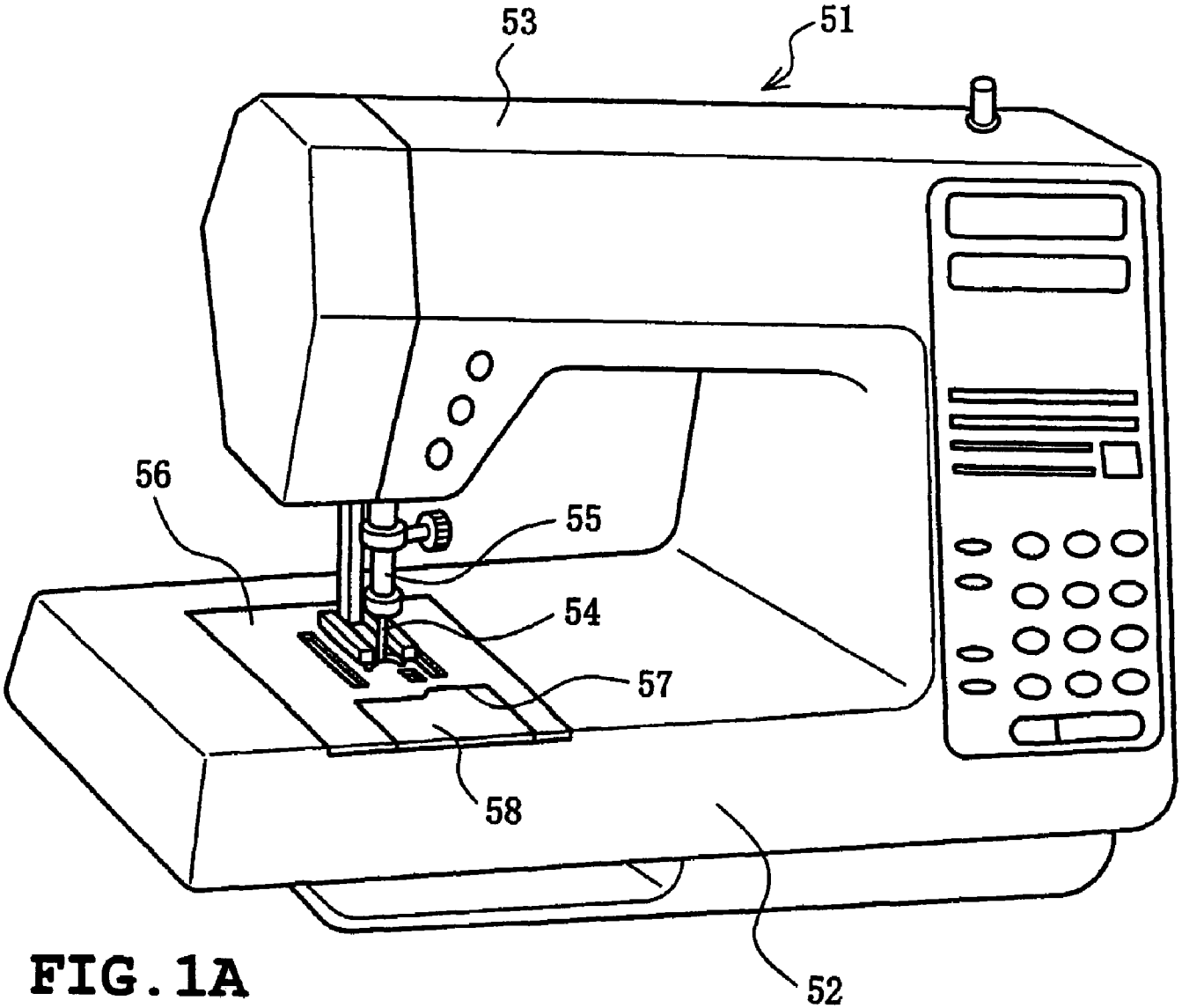
FIG. 1A is a perspective view of a sewing machine in accordance with one illustrative aspect of the invention.
Figure 1B:
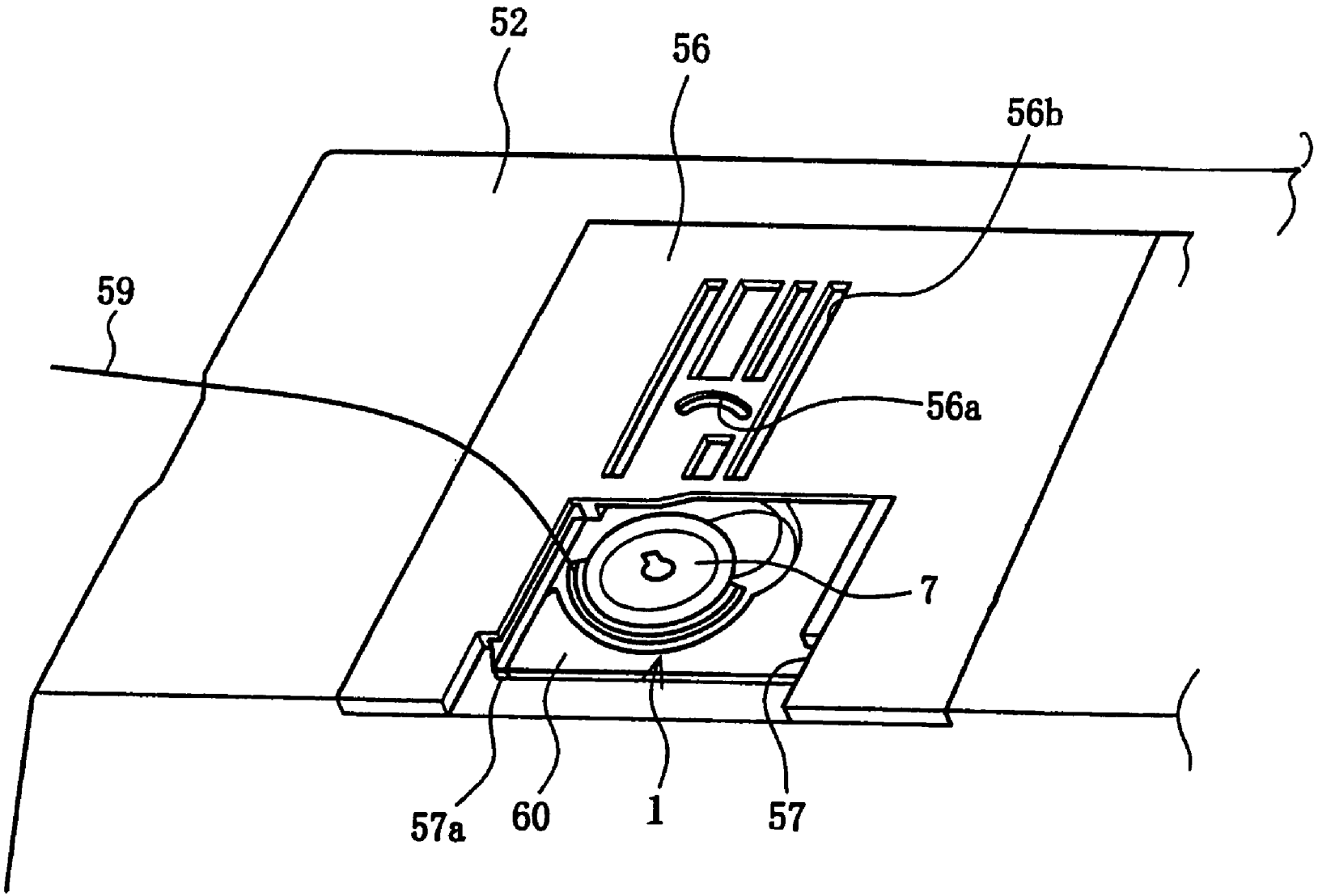
FIG. 1B is an enlarged perspective view of a needle plate of the sewing machine.

An embodiment of the invention will be described with reference to the accompanying drawings. In the embodiment, the invention is applied to a horizontal full rotary hook in which an outer rotating hook is rotated continuously in one direction. Referring first to FIGS. 1A and 1B, an overall construction of the sewing machine will be described. The sewing machine comprises a body 51 including a sewing bed 52 and a sewing arm 53 formed integrally with the bed so as to be mounted over the bed as shown in FIG. 1A. The arm 53 has a distal end having a needle bar 55 provided with a sewing needle 54. The needle bar 55 is moved vertically by a driving mechanism (not shown). On the other hand, a metal needle plate 56 is mounted on an upper surface of the bed 52 so as to be opposed to the needle bar 55. The needle plate 56 has a needle hole through which the needle 54 passes and a plurality of elongate slits 56*b* for actuation of a feed dog (not shown) Further, the needle plate 56 has a rectangular bobbin-accommodating hole 57 located in front of the needle hole 56*a* and the elongate slits 56*b*. The bobbin-accommodating hole 57 has two slide grooves 57*a* formed in right and left portions thereof (only the left slide groove being shown) respectively. A transparent slide lid 58 (see FIG. 1A) is adapted to be inserted into the grooves 57*a* so as to be slidable front and back, thereby closing and opening the bobbin-accommodating hole 57.

A cloth feed mechanism (not shown) is provided inside the bed 52 for driving the feed dog in synchronization with the vertical movement of the needle bar 55. Further, a horizontal full rotary hook 1 of the embodiment is located below the bobbin-accommodating hole 57. The horizontal full rotary hook 1 includes a beak member 5 and an outer rotating hook 3 (see FIG. 2) horizontally rotated in synchronization with the vertical movement of the needle bar 55 and an inner bobbin case holder 2 (see FIG. 2). A bobbin 7 on which a bobbin thread 59 is wound is detachably accommodated in the inner rotating hook bobbin case holder 2 as shown in FIG. 1B. A plastic presser plate 60 is mounted on the underside of the needle plate 56 so as to be located in the bobbin-accommodating hole 57. The presser plate 60 has an opening through which the bobbin 7 is put into and taken out of the bobbin case holder 2. The presser plate 60 further has a rotation limiting portion (not shown) formed on the underside thereof for limiting rotation of the bobbin case holder 2.

In the sewing machine thus constructed, when the rotating hook 3 is rotated counterclockwise in synchronization with the vertical movement of the needle bar 55, a loop of needle thread (not shown) formed by a sewing needle 54 below an eye 56*a* of the sewing needle is caught by a loop seizing beak member 5. This direction of rotation will hereinafter be referred to as "hook rotating direction A." The thread loop is then entangled with the bobbin thread 59 while being passed outside the bobbin case holder 2, whereby a stitch is formed.

Figure 2:
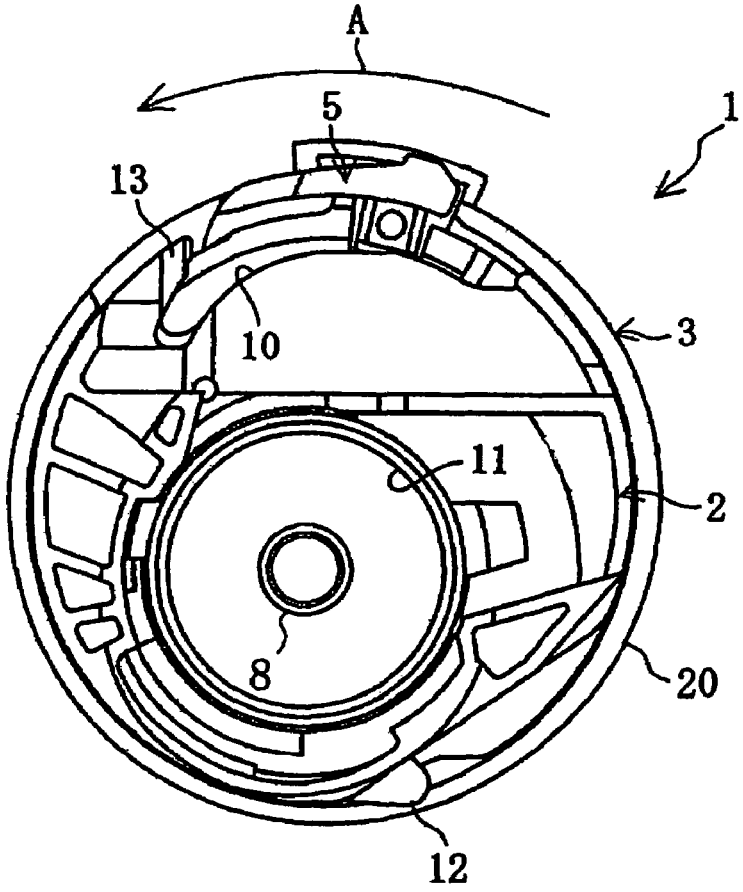
FIG. 2 is a plan view of a horizontal full rotary hook of the sewing machine.
Figure 3:
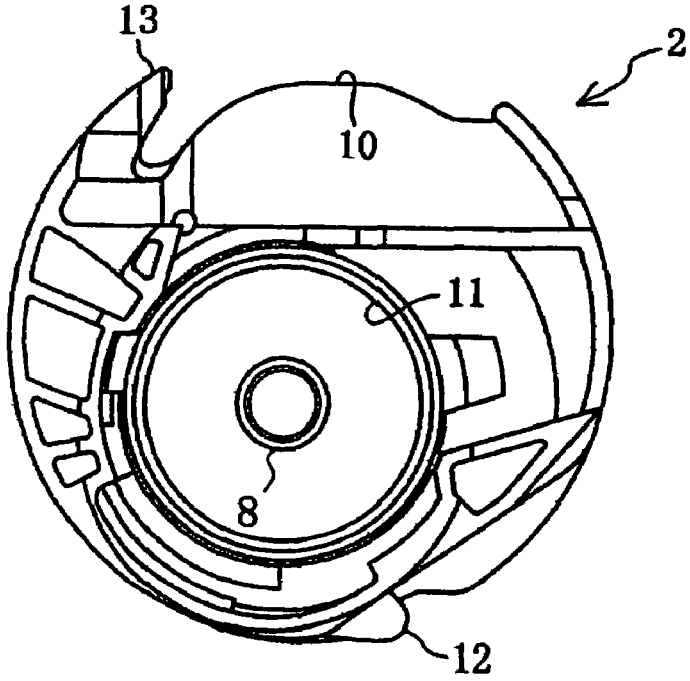
FIG. 3 is a plan view of a bobbin case holder of the sewing machine.

The horizontal full rotary hook 1 will now be described in detail with reference to FIGS. 2 to 12. The bobbin case holder 2 will first be described. Referring to FIGS. 3 and 12, the bobbin case holder 2 is made of a synthetic resin material such as nylon resin and formed into the shape of a substantially cylindrical shallow container. An interior of the bobbin case holder 2 serves as a bobbin-accommodating section 11 for accommodating the bobbin 7. The bobbin case holder 2 has a bottom with a centrally formed shaft 8 with which the bobbin 7 is to be fitted.

Referring to FIG. 3, the bobbin case holder 2 includes an outer periphery formed with a rotation limiter 12 located at the front as viewed in FIG. 3 and preventing rotation of the bobbin case holder 2. The outer periphery of the bobbin case holder 2 is further formed with a notch 10 located at an inner side as viewed in FIG. 3 and allowing the needle 54 to pass through the notch. The notch 10 has one end formed with a protruding thread guide 13. The bobbin-accommodating section 11 has an inner wall provided with a tensioning portion (not shown) for tensioning the bobbin thread 59. The tensioning portion includes an arc plate-shaped thread tension bracket and an also arc plate-shaped thread tension spring both of which are mounted on the inner wall of the bobbin accommodating section 11 in a superposed state.

Figure 5:
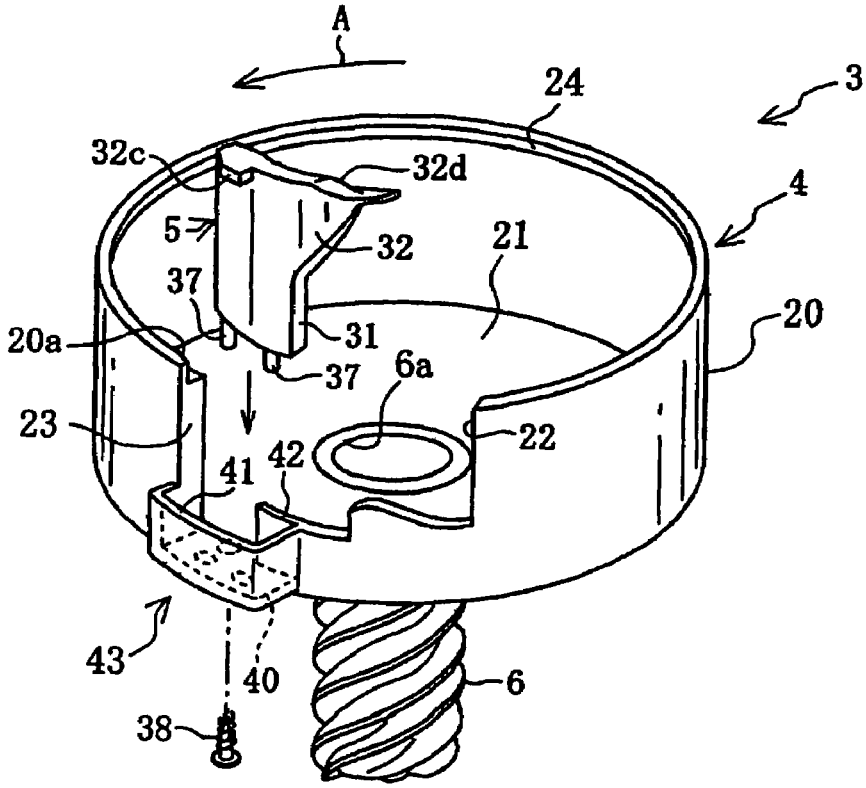
FIG. 5 is a perspective view of the rotating hook with a beak member being exploded.
Figure 6:
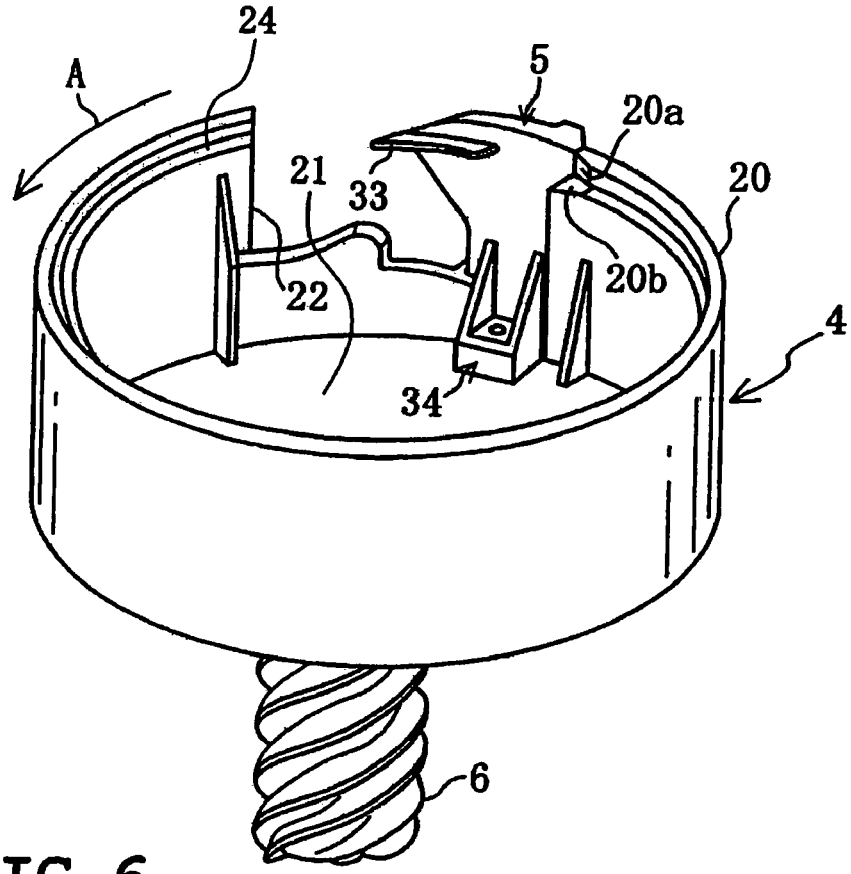
FIG. 6 is a perspective view of the rotating hook as viewed from another angle.

Next, the rotating hook 3 will be described. Referring to FIGS. 5 and 6, the rotating hook 3 includes a cylindrical receptacle-shaped hook body 4 having an open top, a beak member 5 to be mounted on the hook body 4 and a drive shaft 6 extending downward from the central underside of the hook body 4. In the embodiment, the hook body 4 and the drive shaft 6 are each made of a synthetic resin such as nylon resin and are formed integrally with each other, for example, by injection molding. The beak member 5 is made of a synthetic resin such as polyimide resin. The material of the beak member 5 has a higher hardness than the material of the hook body 4.

Figure 7:
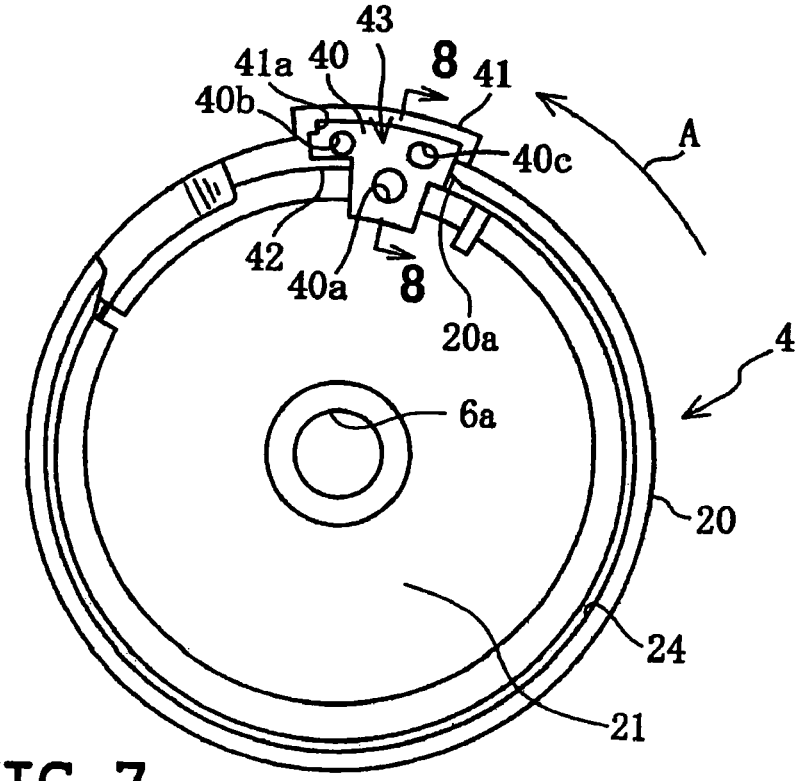
FIG. 7 is a view similar to FIG. 4, showing the condition before the beak member is mounted.

The hook body 4 has a disc-shaped bottom 21 and an outer circumferential wall 20 which is formed integrally with the bottom so as to rise from an outer circumference of the bottom. The hook body 4 has a slightly larger diameter than the bobbin case holder 2. The hook body 4 includes a part formed into a needle thread passing opening 22 through which a needle thread caught by the beak member 5 passes, as shown in FIGS. 5 to 7. The wall 20 is further formed with an enlarged opening 23 (see FIG. 5) which is continuous to the opening 22 and into which the beak member 5 is attached. The outer circumferential wall 20 has an upper edge formed with an annular lace 24 having an inner circumferential side lower by one step than the upper edge. The outer periphery of the bobbin case holder 2 has a lower end placed on the lace 24 so as to be slidable thereon as shown in FIGS. 2 and 12, whereupon the bobbin case holder 2 is adapted to be accommodated in the rotating hook 3 while floating slightly away from the bottom 21. Dashed line K in FIGS. 10 and 11 designates a movement locus of the lower end of the outer periphery of the bobbin case holder 2 sliding on the lace 24.

Figure 4:
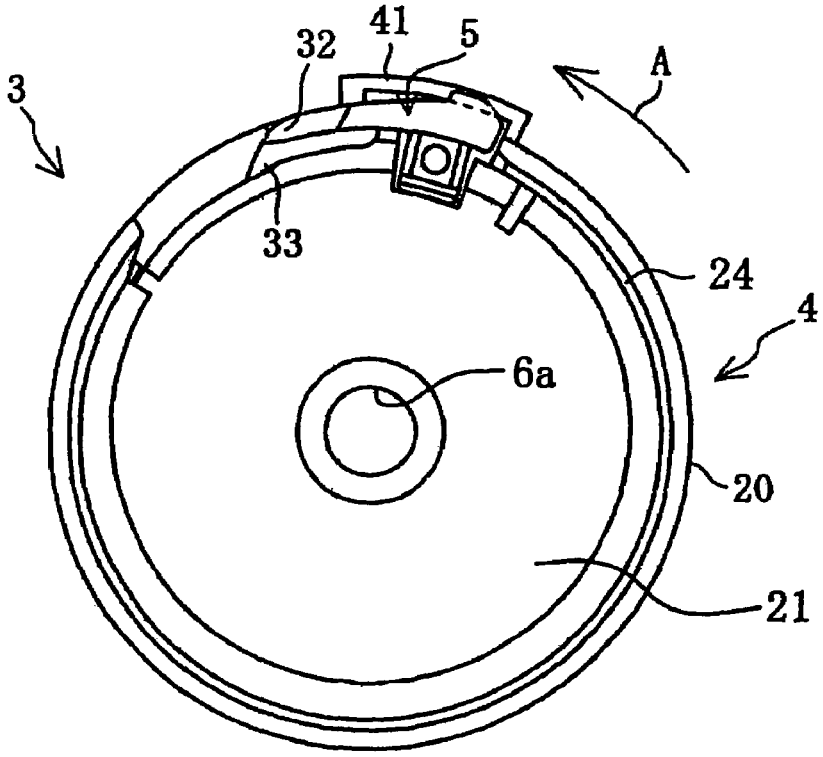
FIG. 4 is a plan view of a rotating hook of the sewing machine.

Referring now to FIGS. 4 and 5, the drive shaft 6 is formed into the shape of a pipe and has a shaft hole 6*a* vertically extending therethrough. The drive shaft 6 further has a worm-gear-like gear formed on the outer circumference thereof. A rotating hook shaft (not shown) is adapted to be inserted through the shaft hole 6*a*. The rotating hook shaft has a lower end fixed to a sewing machine frame (the bottom of the bed 52), thereby rotatably supporting the rotating hook 3. The gear of the drive shaft 6 is brought into mesh engagement with a driving gear of a hook driving mechanism (not shown) so that the rotating hook 3 is rotated via the aforesaid driving gear and drive shaft 6 in the hook rotating direction A.

The beak member 5 is a component separate from the hook body 4 and is detachably attached to the hook body 4 in the embodiment. A mounting structure for the beak member 5 will be described in detail. The construction of the beak member 5 will firstly be described. The beak member 5 has a height equal to that of the outer circumferential wall 20 and is formed into the shape of a plate curved at the same curvature as the wall 20 as viewed from above, as shown in FIGS. 5 and 9 to 11. The beak member 5 is sized so as to close the aforesaid enlarged opening 23. The beak member 5 has substantially a lower half serving as a support wall 31 and an upper half serving as a beak peripheral wall 32 located at the outer periphery side of the lace 24.

Figure 11:
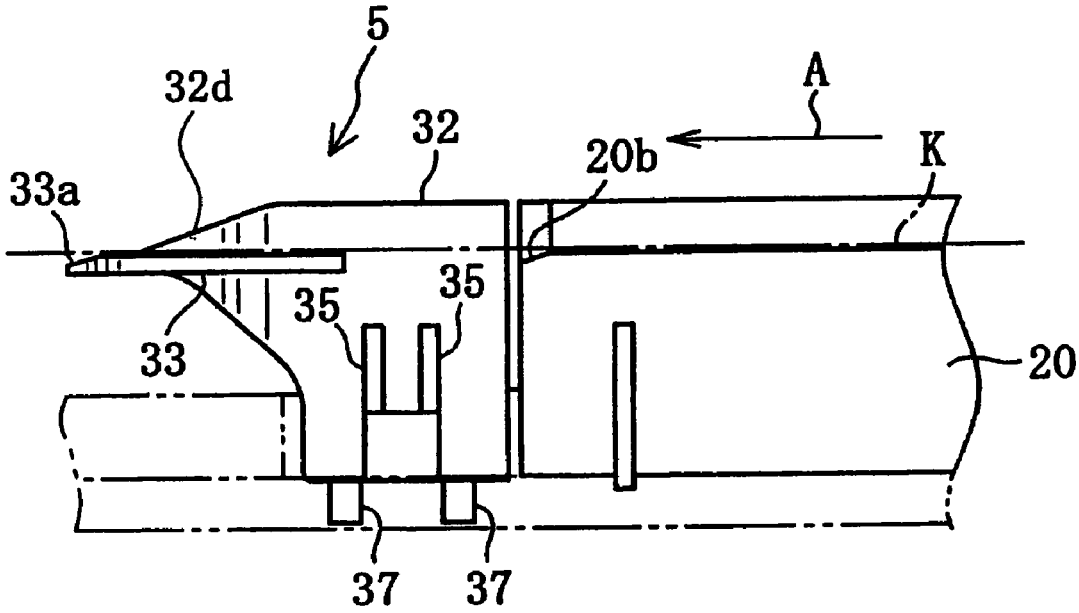
FIG. 11 is a view of the beak as viewed in the direction of arrow J in FIG. 10.
Figure 12:
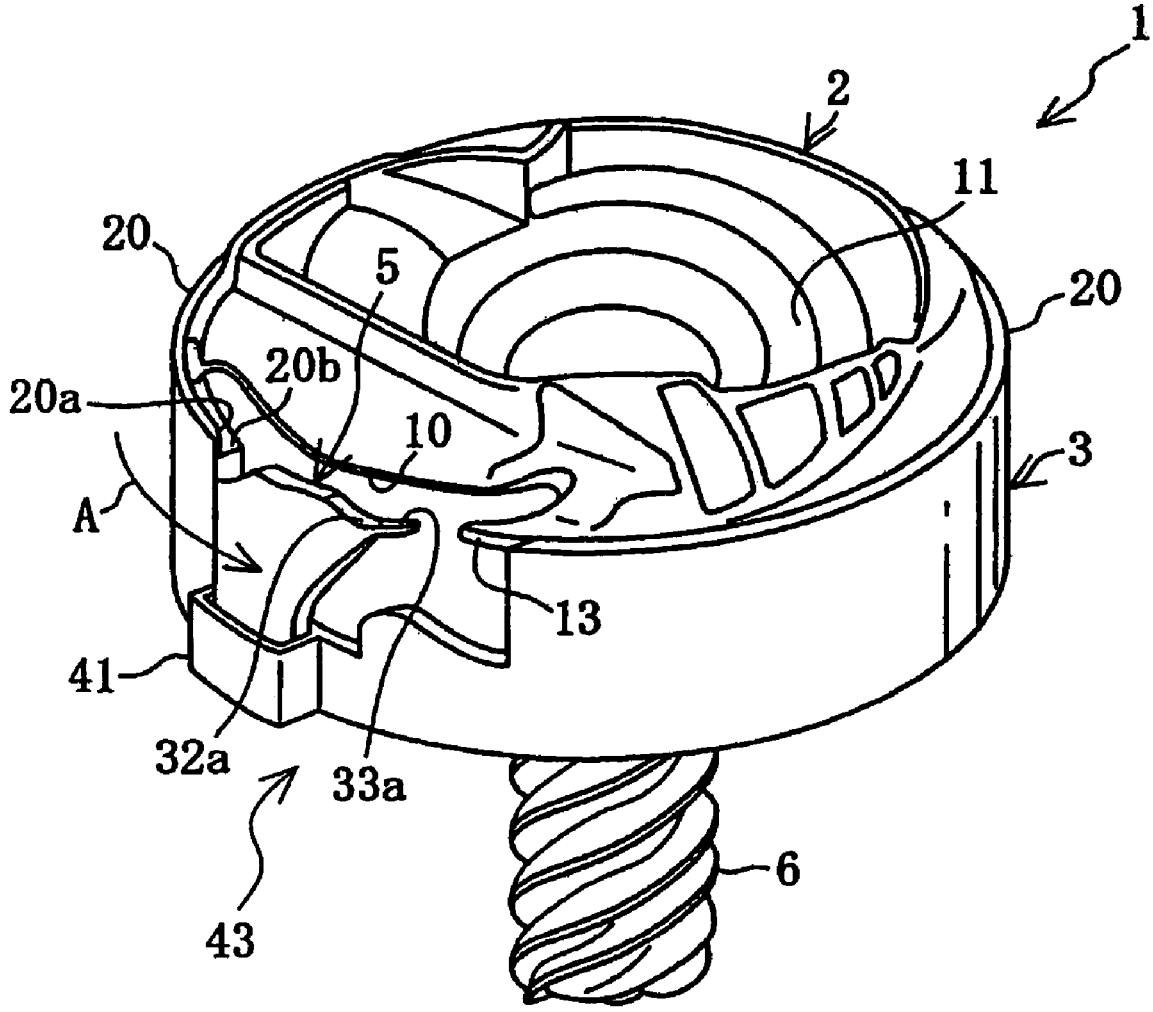
FIG. 12 is a perspective view of a horizontal rotating hook of the illustrative aspect.

The beak peripheral wall 32 has an upper face including a forward side with respect to a rotation direction A of the rotating hook as shown in FIG. 11. A guide face 32*d* is formed on the forward side of the upper face of the beak peripheral wall 32. The beak peripheral wall 32 further has a rearward side upper end formed with an outwardly protruding thread engagement step 32*c*. The thread engagement step 32*c* is provided for engaging and locking the needle thread loop.

The beak peripheral wall 32 also has an inner periphery including a horizontal thin plate-shaped beak body 33 formed integrally with the wall 32 so as to be located near to the lower side of the lace 24 (the side lower than the chain line K) as shown in FIGS. 4, 6 and 9 to 11. The beak body 33 has a forward side end with respect to the rotation direction A of the rotating hook. The forward side end of the beak body 33 is formed so as to extend toward the forward side by a predetermined dimension and so as to protrude inward. The beak peripheral wall 32 and beak body 33 constitute the thread, capturing beak. Furthermore, two positioning pins 37 extend downward from the underside of the support wall 31 of the beak member 5 as shown in FIGS. 5 and 11.

Figure 9:
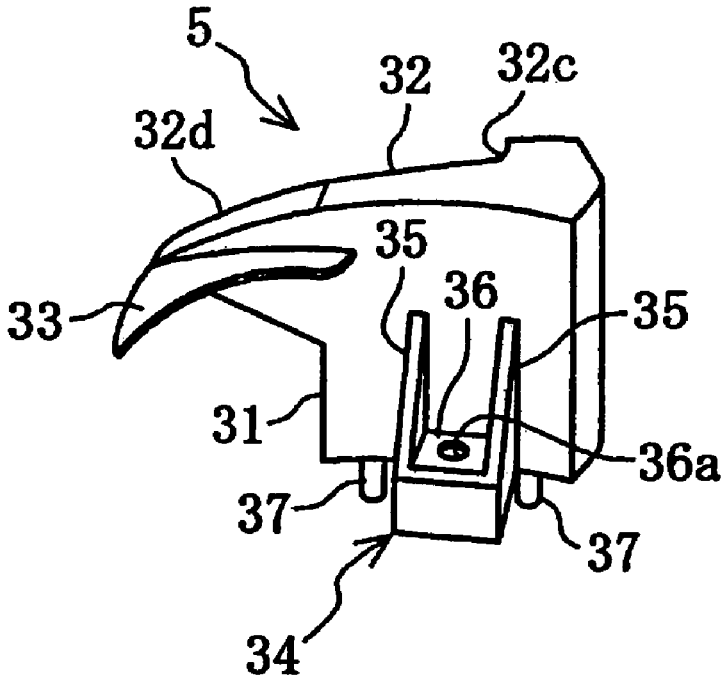
FIG. 9 is a perspective view of the beak member.

A fixing block 34 is integrally formed on the inner periphery of the support wall 31 as shown in FIG. 9. The fixing block 34 includes a bottom 36 mounted on the lower end of the support wall 31 and a pair of substantially triangular side walls 35 extending from opposite ends of the bottom 36. The bottom 36 is formed into a rectangular shape and has a centrally located fixing screw hole 36*a*.

Figure 8:
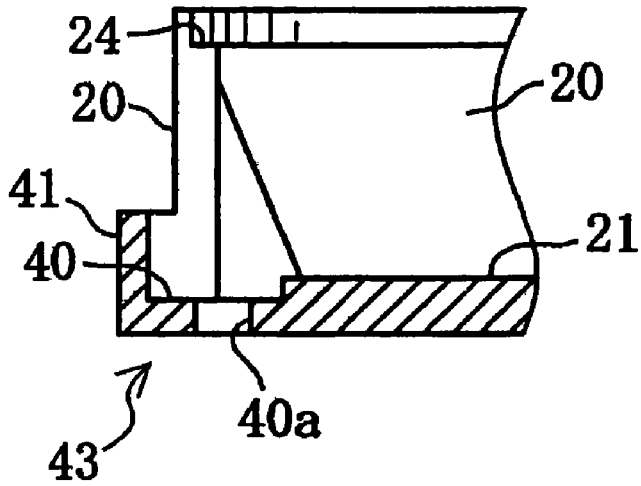
FIG. 8 is a view taken along line 8-8 in FIG. 7.

On the other hand, the hook body 4 is provided with a fitting holder 43 for holding the beak member 5. The fitting holder 43 includes a reinforcing peripheral wall 41 protruding outward from the outer peripheral wall 20 of the hook body 4 and supporting a lower outer face of the beak member 5 as shown in FIGS. 7 and 8. The fitting holder 43 further includes a reinforcing bottom 40 which is continuous to the bottom 21 and constitutes the bottom of the fitting holder 43. Furthermore, the reinforcing peripheral wall 41 has an end having an inner reinforcing wall 42 which is formed adjacent to the inner face of the beak member 5 so as to be parallel with the reinforcing peripheral wall 41. Each of the peripheral walls 41 and 42 has a height set to about one third of the height of the outer peripheral wall 20, for example. The reinforcing peripheral wall 41 has both ends continuous to the outer peripheral wall 20. Furthermore, the reinforcing peripheral wall 41 has a corner located at the forward side with respect to the rotation direction A of the rotating hook as shown only in FIG. 7. A columnar corner support 41*a* is formed on the corner so as to be located at the reinforcing bottom 40 side. Thus, the corner support 41*a*, reinforcing peripheral wall 41 and inner reinforcing wall 42 are abutted against the upwardly inserted beak member 5, thereby holding the beak member 5 in a vertical position.

On the other hand, the reinforcing bottom 40 continuous to the bottom 21 is formed into a generally T-shape as viewed on a plane so as to be located slightly lower than the bottom 21. The reinforcing bottom 40 has a screw hole 40*a* formed an inner part thereof so that the screw hole 40*a* corresponds to the screw hole 36*a* of the fixing block 34 of the beak member 5. The reinforcing bottom 40 further has a circular pin hole 40*b* for positioning the beak member 5 and an elongate circular pin hole 40*c* which is slightly longer laterally than the pin hole 40*b*. The pin holes 40*b* and 40*c* are formed so as to correspond to the aforesaid two positioning pins 37 respectively. A small fixing screw 38 is inserted upward through the screw hole 40*a* to be screwed into the screw hole 36*a* of the fixing block 34 (see FIG. 5), whereby the beak member 5 is fixed to the rotating hook 3.

Figure 10:
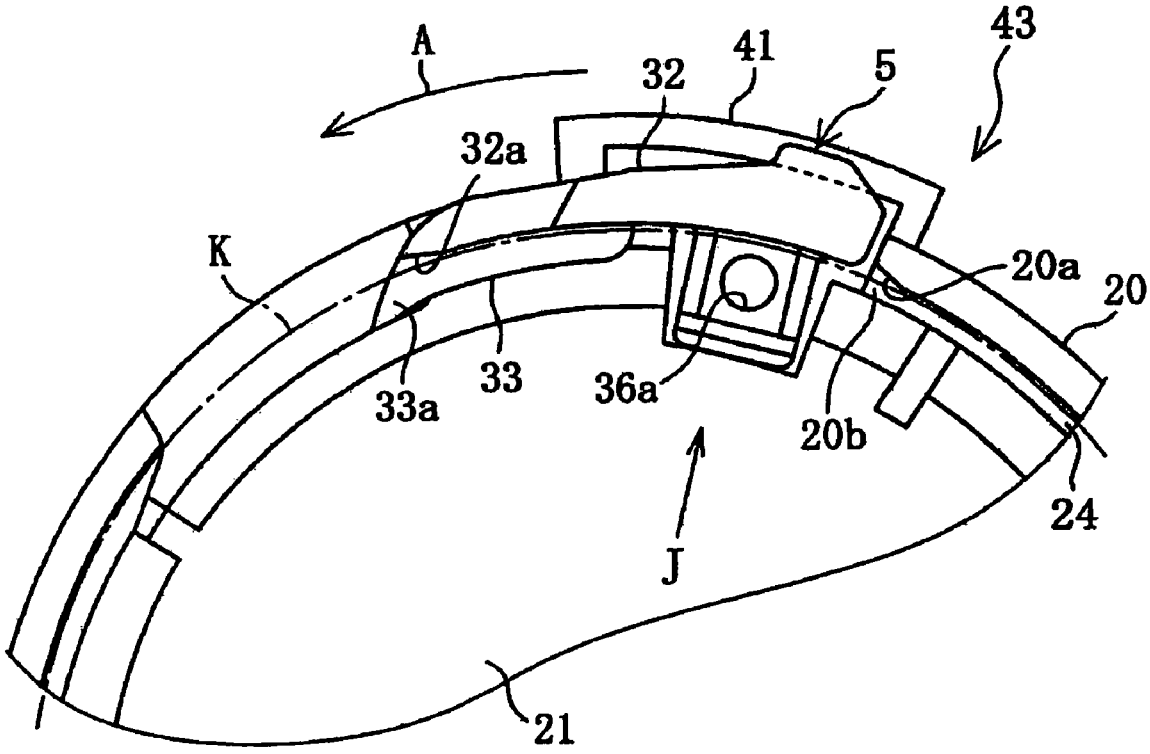
FIG. 10 is an enlarged plan view of a beak of the sewing machine.

A plurality of inclined faces 32*a*, 33*a*, 20*a* and 20*b* are adapted to be formed when the beak member 5 and the rotating hook 5 are injection-molded. More specifically, as shown in FIG. 10, the first inclined face 32*a* is formed on a forward end of the beak peripheral wall 32 with respect to the rotation direction A of the rotating hook 3. The first inclined face 32*a* is inclined forwardly outward. The second inclined face 33*a* is formed on a forward end of the beak body 33 with respect to the rotation direction A of the rotating hook 3 as shown in FIG. 11. The second inclined face 33*a* is inclined forwardly downward.

On the other hand, the third inclined face 20*a* is formed on an edge of the outer peripheral wall 20 fronting to the aforesaid enlarged opening 23 and the beak member 5 as shown in FIGS. 6 and 10. The third inclined face 20*a* is inclined forwardly outward. Furthermore, as shown in FIG. 11, the fourth inclined face 20*b* is formed on a forward edge of the lace 24. The fourth inclined face 20*b* is inclined forwardly downward. As the result of provision of the inclined faces 32*a*, 32*b*, 20*a* and 20*b*, the bobbin case holder 2 is adapted to slide on the lace 24 smoothly.

An operation and effect of the horizontal rotary hook constructed above will now be described. The beak member 5 is mounted on the rotating hook 3 in the manner as described below. Firstly, the beak member 5 is fitted with the fitting holder 43 provided on the rotating hook 3 from above as shown in FIG. 5. In this case, the beak member 5 is inserted while being guided by the reinforcing peripheral wall 41 and inner reinforcing wall 42. As a result, the positioning pins 37 formed on the lower end of the beak member 5 are inserted into the pin holes 40*b* and 40*c* formed in the reinforcing bottom 40 respectively. Since the beak member 5 is thus fitted in the fitting holder 43, the beak member 5 can easily be positioned.

The pin hole 40*c* which is slightly longer laterally than the pin hole 40*b*. Accordingly, even if the distance between the positioning pins 37 has a dimensional error, the error can be absorbed by the elongate pin hole 40*c*. Consequently, the beak member 5 can be mounted on the rotating hook 5 reliably and accurately, and productivity and workability can be improved. Furthermore, since the beak member 5 is guided by the reinforcing peripheral wall 41 and inner reinforcing wall 42 onto the reinforcing bottom 40 of the fitting holder 43, the beak member 5 can readily be mounted on the rotating hook 3.

When the beak member 5 is located on the reinforcing bottom 40, the fixing screws 38 of the beak member 5 are screwed into the screw holes 40*a* and 36*a* respectively so that the beak member 5 is fixed via the fixing block 34 to the rotating hook 3. Consequently, the beak member 5 is stably fixed to and reliably mounted on the rotating hook 3. Furthermore, the two positioning pins 37 are in engagement with the pin holes 40*b* and 40*c* respectively. As a result, even when the beak member 5 is instantaneously subjected to an external stress caused by thread entanglement or the like and acting outward, the strength of the beak member 5 can be increased so as to withstand the stress.

Moreover, in this case, the corner support 41*a*, reinforcing peripheral wall 41 and inner reinforcing wall 42 are constructed to be caused to abut against the beak member 5, thereby holding the beak member 5 in a vertical position. More specifically, the outer surface of the beak member 5 abuts against the inner surface of the reinforcing peripheral wall 41, and the forward side of the beak member 5 with respect to the rotation direction A of the rotating hook 3 abuts against the corner support 41*a* from inside. The inner surface of the forward side of the beak member 5 with respect to the rotation direction A of the rotating hook 3 abuts against the inner reinforcing wall 42 from outside. Accordingly, the beak member 5 is reinforced as the result of the abutment against the corner support 41*a*, reinforcing peripheral wall 41 and inner reinforcing wall 42. Consequently, the strength overcoming the aforesaid external stress can be ensured.

Furthermore, since the beak member 5 is fixed to the rotating hook 3 by the fixing screw 38, only the beak member 5 can easily be replaced as occasion demands. As a result, the replacement can render the replacement cost lower than the replacement of the whole rotating hook 3. Since a synthetic resin is employed as the material for the beak member 5, the beak member can readily be formed into a product. The synthetic resin can reduce the production cost of the beak member 5 as compared with the beak member is made of a metal. More specifically, since the rotating hook 3 is made of a nylon resin and the beak member 5 is made of a polyimide resin having a higher hardness than the nylon resin, a sufficient hardness can be ensured for the beak member 5. Additionally, the production cost can be reduced in this case as compared with the case where the whole rotating hook 3 is made of the polyimide resin.

Furthermore, the enlarged opening 23 is formed so as to be continuous to the needle-thread passing opening 22. The beak member 5 is mounted on the rotating hook 3 so as to close the enlarged opening 23. Accordingly, the thickness of the outer peripheral wall 20 need not be increased. Thus, the beak member 5 and the rotating hook 3 can be composed as discrete components while the size of the rotating hook 3 is prevented from being increased. Furthermore, even when the beak member 5 and the rotating hook 3 are separate from each other, the outer peripheral wall 20 of the rotating hook 3 can be extended by the beak peripheral wall 32, whereupon the needle thread can reliably be captured. Additionally, the beak body 33 is formed so as to extend toward the forward side by the predetermined dimension and so as to protrude inward. Consequently, the needle thread can be captured more effectively and more reliably.

In a sewing operation, the rotating hook 3 is rotated in the rotation direction A by a hook driving mechanism (not shown) such that the bobbin case holder 2 is rotated relative to the rotating hook 3 while being supported on the lace 24 (see FIG. 12).

The beak peripheral wall 32 is located outside the lace 24 of the rotating hook 3 (outside the chain line K) and is continuous to the outer peripheral wall 20. Consequently, the bobbin case holder 2 can smoothly be rotated without interference with the beak peripheral wall 32.

The thread guide 13 of the bobbin case holder 2 is prevented from colliding with the beak peripheral wall 32 and beak body 33 when passing over the beak body 33. More specifically, the beak peripheral wall 32 is formed with the first inclined face 32*a* and the beak body 33 is formed with the second inclined face 33*a*. Each inclined face is located at the forward side of the beak member 5 with respect to the rotation direction A of the rotating hook 3. Since the thread guide 13 is guided by the inclined faces 32*a* and 33*a*, the thread guide 13 of the bobbin case holder 2 can smoothly pass over the beak member 5.

Furthermore, the thread guide 13 can be prevented from colliding with the forward side edge of the outer peripheral wall 20 when passing the forward side edge of the outer peripheral wall 20. More specifically, the forward side edge of the outer peripheral wall 20 is formed with the third and fourth inclined faces 20*a* and 20*b* both located at the forward side with respect to the rotation direction A of the rotating hook 3. Since the thread guide 13 is guided by the third and fourth inclined faces 20*a* and 20*b*, the thread guide 13 can smoothly pass the forward edge of the outer peripheral wall 20.

Several modified forms of the foregoing embodiment will now be described. The beak member 5 may be made of a metal, instead. Three or more positioning pins 37 may be formed on the beak member 5. Also, three or more pin holes may be formed in the reinforcing bottom 40. When a sufficient space is allowed to be provided around the rotating hook 3, the reinforcing peripheral wall 41 may have a height increased up to about a half of a height of the outer peripheral wall 20. In this case, the reinforcement strength of the beak member 5 can further be improved.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A horizontal rotary hook for a sewing machine, which includes an inner bobbin case holder accommodating a bobbin therein and an outer rotating hook enclosing the bobbin case holder and rotated in a predetermined direction with the bobbin case holder being accommodated in the rotating hook, the rotating hook having an outer peripheral wall formed with a bobbin-thread passing opening through which the bobbin thread passes, the horizontal rotary hook comprising:

an enlarged opening defined in the outer peripheral wall of the rotating hook so as to be continuous to the bobbin-thread passing opening;

a beak member separate from the rotating hook and mounted on the rotating hook so as to close the enlarged opening; and a fitting holder provided on the rotating hook so that a lower part of the beak member is fitted thereinto, thereby holding the beak member;

wherein the beak member has an outer surface, the rotating hook has a bottom, and the fitting holder is formed so as to protrude outward from the outer peripheral wall of the rotating hook and has a reinforcing peripheral wall continuous to the outer peripheral wall of the rotating hook and supporting the outer surface of the beak member and a reinforcing bottom continuous to the bottom of the rotating hook.

2. The horizontal rotary hook according to claim 1, wherein the beak member is made of a synthetic resin.

3. The horizontal rotary hook according to claim 1, wherein the outer rotating hook is made of a synthetic resin.

4. The horizontal rotary hook according to claim 1, wherein the beak member is made of a material having a higher hardness than a material of the outer rotating hook.

5. The horizontal rotary hook according to claim 1, wherein the beak member has a lower end formed with a plurality of positioning pins, and the reinforcing bottom of the fitting holder has a plurality of pin holes into which the positioning pins are inserted respectively.

6. The horizontal rotary hook according to claim 5, wherein at least one of the pin holes is larger than the other hole or holes.

7. The horizontal rotary hook according to claim 1, wherein the beak member is mounted on the bottom of the rotating hook by a screw.

* * * * *